US007431563B2

(12) United States Patent
Kraemer et al.

(10) Patent No.: US 7,431,563 B2
(45) Date of Patent: Oct. 7, 2008

(54) WHEEL

(75) Inventors: Johann Kraemer, Leonberg (DE); Erwin Schmidt, Baltmannsweiler (DE); Siegfried Sumser, Stuttgart (DE)

(73) Assignee: Daimler AG, Stuttgart (DE)

( * ) Notice: Subject to any disclaimer, the term of this patent is extended or adjusted under 35 U.S.C. 154(b) by 232 days.

(21) Appl. No.: 10/535,151

(22) PCT Filed: Oct. 16, 2003

(86) PCT No.: PCT/EP03/11485

§ 371 (c)(1),
(2), (4) Date: Nov. 28, 2005

(87) PCT Pub. No.: WO2004/046559

PCT Pub. Date: Jun. 3, 2004

(65) Prior Publication Data

US 2006/0104816 A1 May 18, 2006

(30) Foreign Application Priority Data

Nov. 15, 2002 (DE) ..... 102 53 299

(51) Int. Cl.
*F04D 29/28* (2006.01)

(52) U.S. Cl. ..... 416/188; 416/229 A

(58) Field of Classification Search ..... 416/230, 416/229 A, 188, 229 R, 185
See application file for complete search history.

(56) References Cited

U.S. PATENT DOCUMENTS

2002/0001522 A1* 1/2002 Mukherjee et al. ..... 416/185

* cited by examiner

*Primary Examiner*—Richard Edgar
(74) *Attorney, Agent, or Firm*—Patent Central LLC; Stephan A. Pendorf

(57) ABSTRACT

A wheel (10) comprises a main body (12) and is provided with at least one reinforcing structure (14) which increases the strength of the wheel (10). The reinforcing structure (14) is at least partially integrated inside the main body (12).

15 Claims, 4 Drawing Sheets

WHEEL

CROSS REFERENCE TO RELATED APPLICATION

This application is a national stage of PCT/EP2003/011485 filed Oct. 16, 2003 and based upon DE 102 53 299.0 filed Nov. 15, 2002 under the International Convention.

BACKGROUND OF THE INVENTION

1. Field of the Invention

The invention relates to a wheel, having a main body and at least one reinforcing structure which increases the strength of the wheel.

2. Related Art of the Invention

Wheels of the aforementioned type are known in the art. DE 199 12 715 A1, for example, discloses an aluminum compressor wheel, having a reinforcing ring affording greater specific strength than aluminum arranged at the nave thereof. The reinforcing ring may be made from a high-strength plastic material, such as a thermoplastic material reinforced with continuous fibers. This reduces the stresses occurring in the aluminum in the nave area.

SUMMARY OF THE INVENTION

The object of the invention is to propose a wheel of the generic type which is characterized by increased strength and which at the same time is relatively easy to manufacture from a production engineering standpoint.

The distinguishing feature of the wheel according to the invention is that the reinforcing structure is at least partially integrated inside the main body. This makes it possible to increase the strength of the wheel in such a way that it is matched to the prevailing wheel stresses or those to be anticipated in operation. The strength can therefore be increased particularly in the intensively stressed areas of the wheel, so that the main body has favorable operating characteristics particularly in these areas. At the same time, integration of a suitable reinforcing structure in the main body of the wheel is relatively easy to achieve from a production engineering standpoint. For example, the reinforcing structure can be at least partially integrally cast with the main body. The lost-wax casting process (precision casting process), for example, in which a suitable reinforcing structure is integrated in a wax model of the wheel and the wheel wax model is melted out during the actual wheel casting process, leaving the position of the reinforcing structure especially well defined in the wheel material, is particularly suited to this. Such a wheel manufacturing method permits a flexible arrangement of the reinforcing structure in the main body, allowing different reinforcing structures to be used, as required.

The main body advantageously has a nave component and a blade component, the reinforcing structure being arranged in the nave component and/or in the blade component. This makes it possible to increase the overall strength of the wheel, whilst at the same time being able to use the reinforcing structure, as necessary, to reinforce strength-critical areas of the wheel.

According to one possible embodiment the reinforcing structure may take the form of a prefabricated reinforcing element. For example, the reinforcing element may be a strengthening tube, which is integrated in the nave component of the wheel. From a production engineering standpoint such a reinforcing element can be integrated with relative ease into a main body of the wheel to be cast. At the same time, reinforcing elements of differing geometry and/or strength can, where necessary, be provided in one and the same wheel, depending on the sphere of application of the wheel. In the case of a strengthening tube its internal tube surface may form the whole or part of the nave hole surface. The reinforcing element may furthermore be manufactured from the same basic material as the wheel or from a different type of basic material, the reinforcing structure being at least partially integrated in the basic material.

The reinforcing structure preferably has a mesh inlay. In this case the mesh inlay may have a constant mesh width and/or one adapted to the particular wheel geometry. It is furthermore possible for the mesh inlay to comprise a plurality of mesh components extending in a radial direction and/or in an axial direction and/or in a peripheral direction relative to the wheel. The different mesh components allow a three-dimensional stress condition occurring in the wheel to be compensated for in such a way that undesirable wheel deformations and/or damage are avoided. The mesh inlay may also take the form of skeletal lines extending helically from the inside outwards.

The mesh inlay may be arranged, at least in part, immediately below the surface of the main body and/or at least partially at the surface of the main body. This allows the strength to be tailored to suit the stress on the exposed surface of the main body. It is also possible, by means of the mesh inlay components situated at the exposed surface of the main body, to optimize the wear characteristics of the wheel. At least a part of the exposed surface of the wheel can also, if necessary, be coated with a high-strength reinforcing structure material. It is furthermore possible, by means of a reinforcing structure in the form of a mesh, for example, extending on the flow surfaces of the wheel, purposely to promote turbulence of the operating medium, thereby possibly improving the thermodynamic efficiency of the wheel.

According to one possible design variant the reinforcing structure may additionally have a reinforcing component arranged entirely externally in relation to the main body and fixed thereto. This creates further possibilities for flexibly increasing the strength of the wheel. At the same time the reinforcing component can, if necessary, also be provided with a reinforcing structure.

As a stiffening element at least partially reproducing the blade geometry, the external reinforcing component is advantageously provided with an inlay structure. Here too, the inlay structure is at least partially integrated in the stiffening element. Such stiffening elements are relatively easy to cast. Furthermore, the main body of the wheel and the stiffening element can, if necessary, be manufactured from different materials.

According to an alternative embodiment the external reinforcing component may take the form of a high-strength circular banding unit. This also permits flexible adjustment of the wheel strength to the stresses to be anticipated in operation of the wheel.

The reinforcing structure is preferably prestressed under a pretensile stress serving to increase the compressive strength. The desired pretensile stressing of the reinforcing structure may be achieved through the use, during the casting process of a coefficient of thermal expansion different from that of the material in the main body of the wheel. It is furthermore possible to build up corresponding pretensile stresses even before the actual casting process by means of an external pretensile force in the reinforcing structure of the wheel.

Alternatively or in addition to this the reinforcing structure may have a multiplicity of reinforcing fibers freely distributed in the main body. Such reinforcing fibers are therefore not connected to one another and may be uniformly distributed or may be arranged in varying concentrations in different areas of the main body of the wheel. They are preferably made from a high-strength material.

The reinforcing structure advantageously contains high-strength metal fibers and/or carbon fibers and/or glass fibers. Such fibers are particularly suitable as reinforcing material in order to obtain increases in the strength of the wheel that can be flexibly adapted to anticipated wheel stresses.

The main body is preferably made using aluminum as basic material. Aluminum is a proven material for the manufacture of wheels and a relatively inexpensive compared to high-strength titanium.

The wheel may be a compressor wheel and in particular a compressor wheel for an exhaust-gas turbocharger compressor wheel. The ever-increasing engine outputs of motor vehicles mean that correspondingly high strength demands are placed on such wheels, especially in the area of the nave, which demands can now be met by relatively inexpensive means.

Further advantages of the invention are set forth in the description.

BRIEF DESCRIPTION OF THE DRAWINGS

The invention will be explained on the basis of several preferred exemplary embodiments and with reference to a schematic drawing, in which.

DETAILED DESCRIPTION OF THE INVENTION

Figure 1:
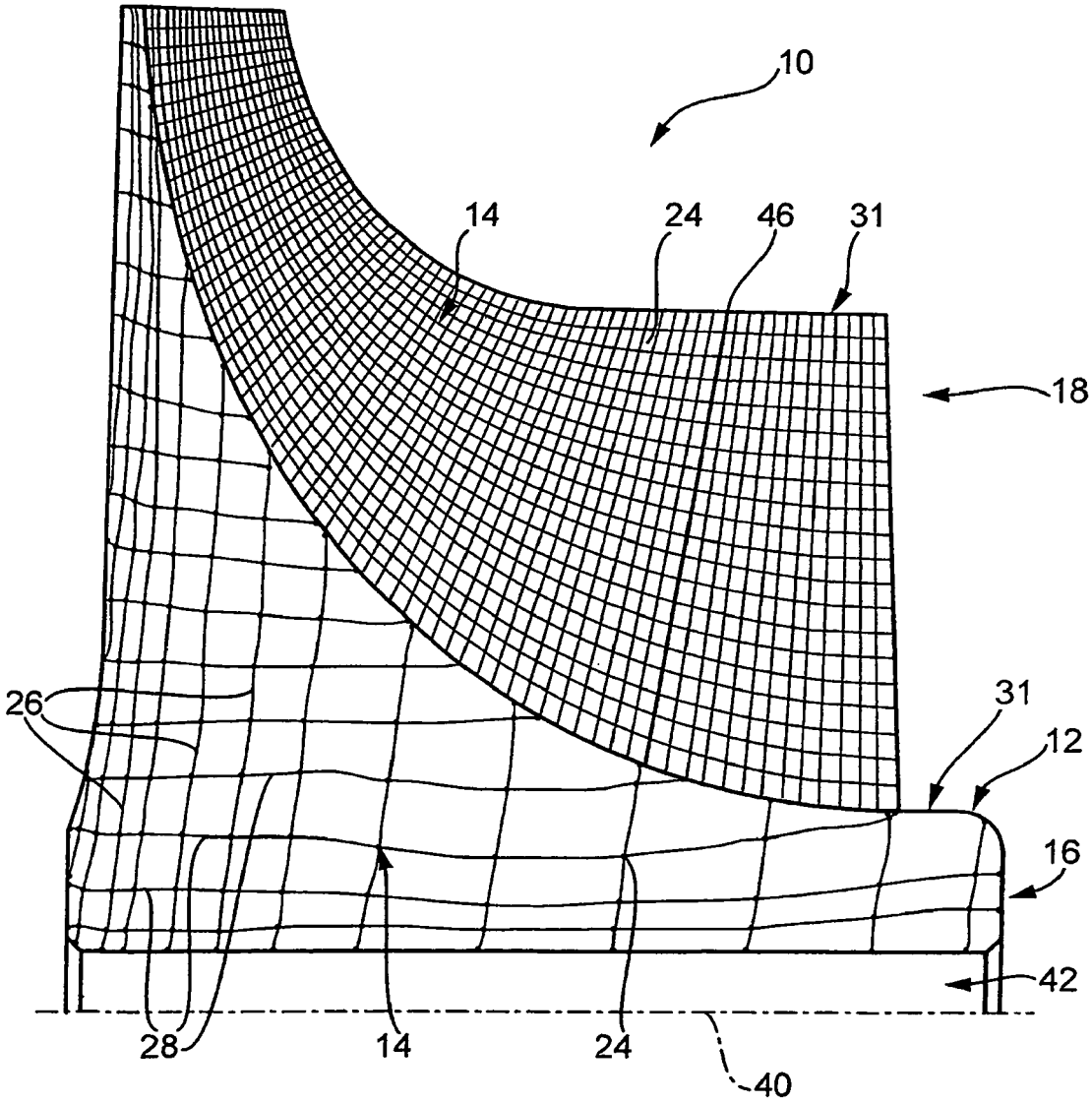
FIG. 1 shows a schematic sectional representation of a part of a wheel according to the invention.
Figure 2:
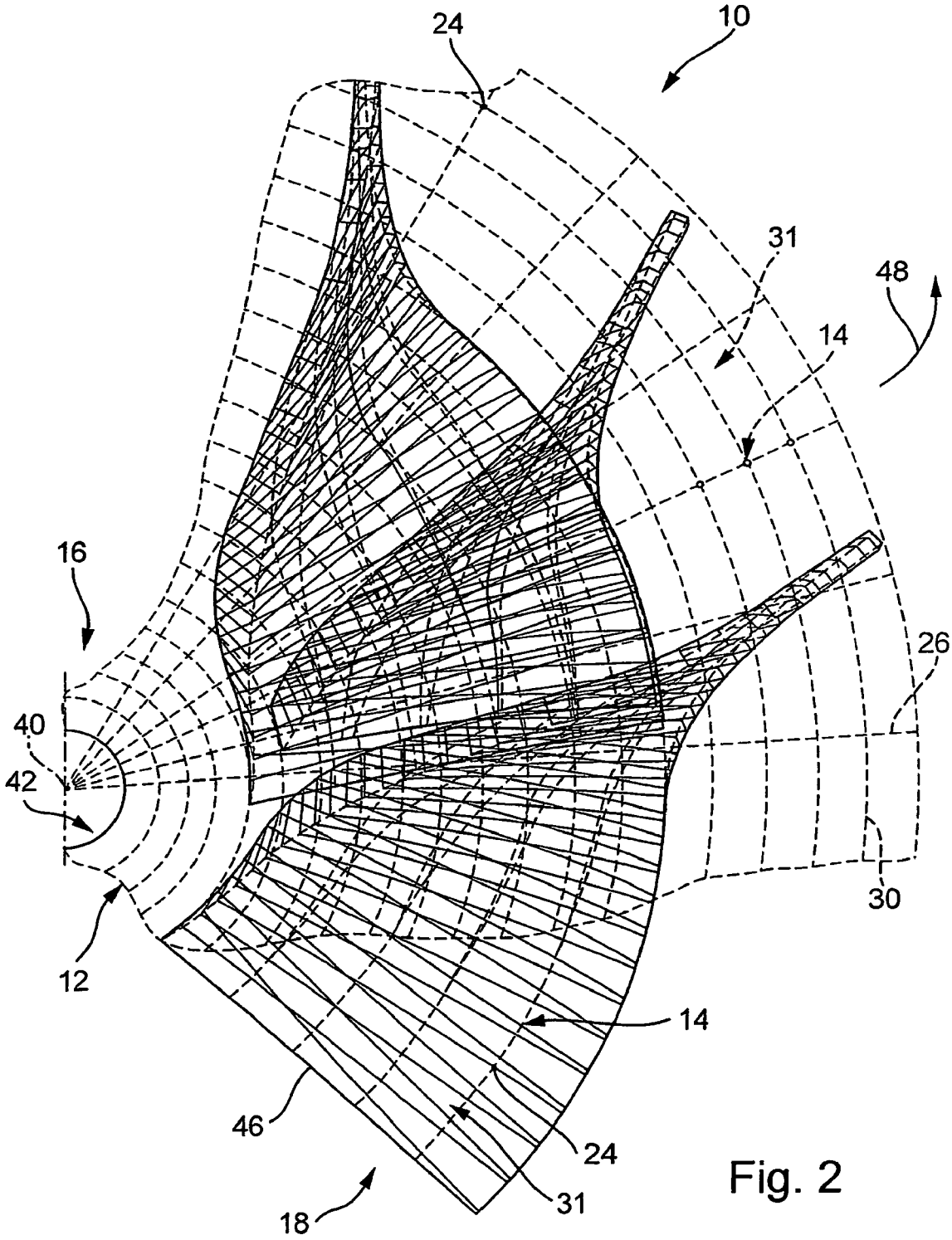
FIG. 2 shows a schematic top view of a part of the blade area of the wheel in FIG. 1.
Figure 3:
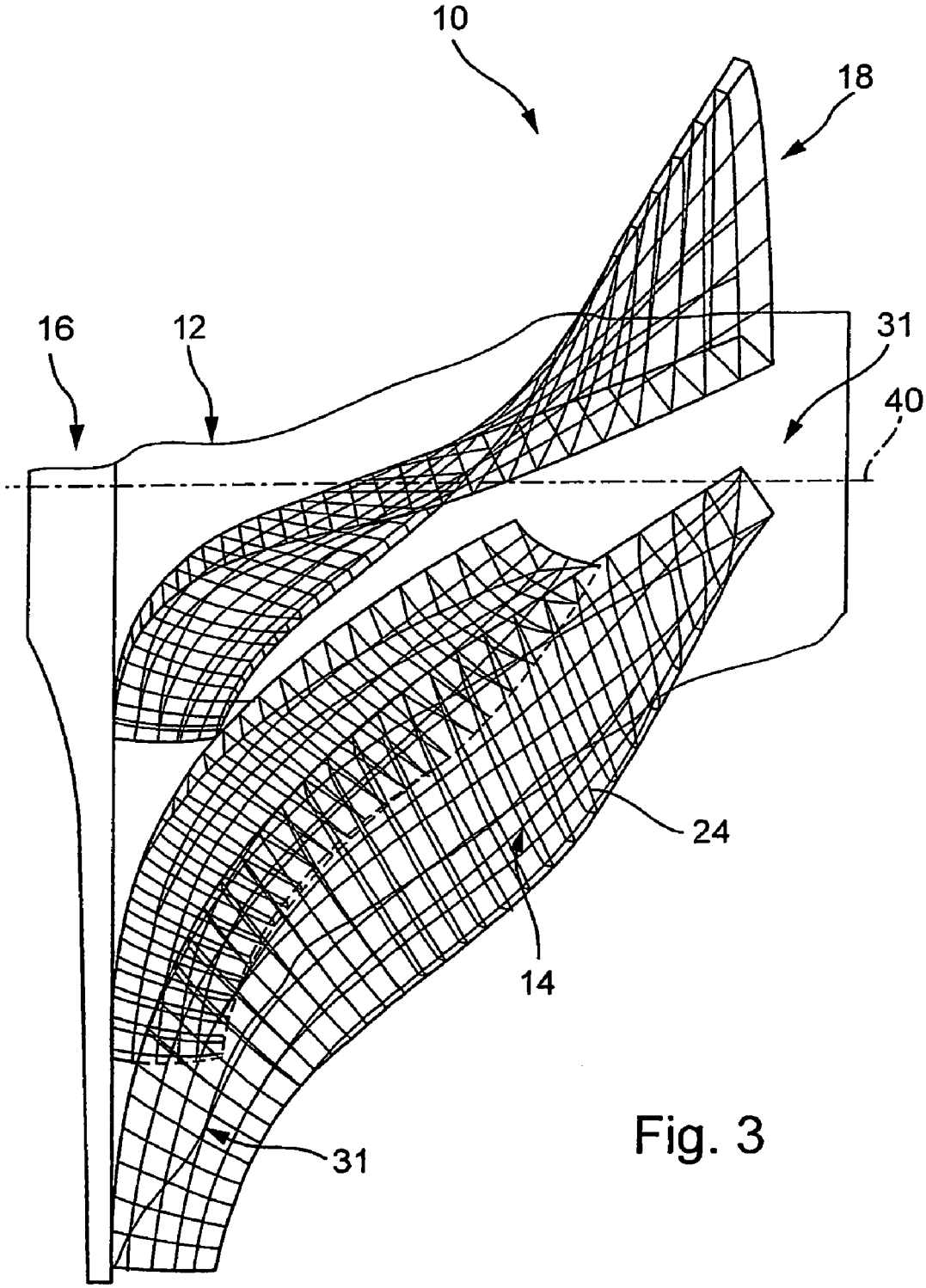
FIG. 3 shows a schematic side view of a part of the wheel in FIG. 2.

FIGS. 1 to 3 show different schematic views of part of a wheel 10 in a first embodiment. The wheel 10 is a so-called "splitter blade". The wheel 10 comprises a main body 12, which has a nave component 16 and a blade component 18. Both the nave component 16 and the blade component 18 are provided with a reinforcing structure 14. The mesh inlay 24 has differing mesh structures and mesh widths in the nave component 16 and the blade component 18. Mesh structures adapted to the respective stress loading are also provided in different areas of the nave component 16 and the blade component 18. The mesh inlay 24 in both the nave component 16 and the blade component 18 comprises mesh components 26, which extend in a radial direction, mesh components 28, which extend in an axial direction, and mesh components 30 which extend in a peripheral direction. Here the mesh inlay 24 extends over the entire main body 12 of the wheel 10 to the exposed surface 31 thereof.

The wheel 10 in FIG. 1 is represented with a wheel blade which is turned in a meridional plane. The mesh inlay 24 in the blade component 18 is arranged in a defined skeletal plane inside the blade represented and fulfils the function of supporting structure for the basic material. In the exemplary embodiment shown the mesh components and skeletal filaments oriented axially, radially and peripherally both in the nave component 16 and in the blade component 18 are linked to one another at nodal points. The entire wheel 10 may be cast, for example, using a conventional aluminum alloy as main body material (basic material). According to FIG. 3 the blades of the wheel 10 are curved backwards. To illustrate the wheel geometry the axis of rotation 40, the nave hole 42, the splitter blade inlet 46 and the wheel outlet 48 (see FIGS. 1 and 2 in particular) are also represented in FIGS. 1 to 3.

Figure 4:
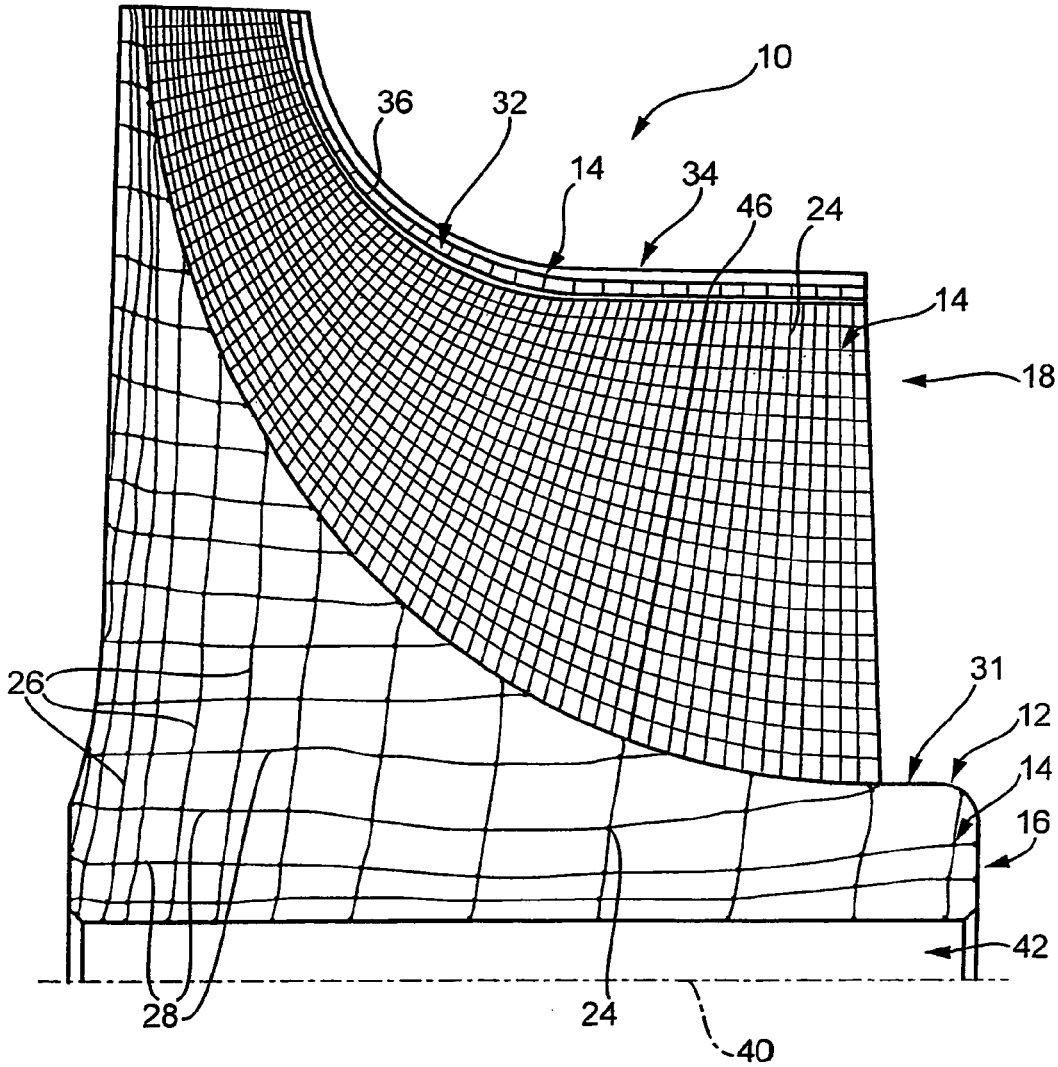
FIG. 4 shows a schematic sectional representation of a part of a wheel according to the invention in an alternative embodiment and FIG. 5 shows a schematic sectional representation of a reinforcing element for a wheel according to the invention.

FIG. 4 shows a wheel 10, which is of a design similar to that in FIGS. 1 to 3. In contrast to the exemplary embodiment in FIGS. 1 to 3, the wheel 10 in FIG. 4 is additionally provided with an external reinforcing component 32, which takes the form of a stiffening element 34 reproducing the blade geometry of the wheel 10. The reinforcing component 32 is firmly connected to main body 12 of the wheel 10 externally on the blade component 18. At the same time the stiffening element 34 is provided with an inlay structure 36, which likewise takes the form of a mesh inlay extending in three dimensions. The reinforcing component 32 designed as cover ring is connected to the respective blades of the wheel 10, for example as an integral casting. According to an alternative embodiment the external reinforcing component 32 may also take the form, where necessary, of a high-strength circular banding unit. The remaining structure of the wheel 10 in FIG. 4 corresponds to that in FIGS. 1 to 3.

Figure 5:
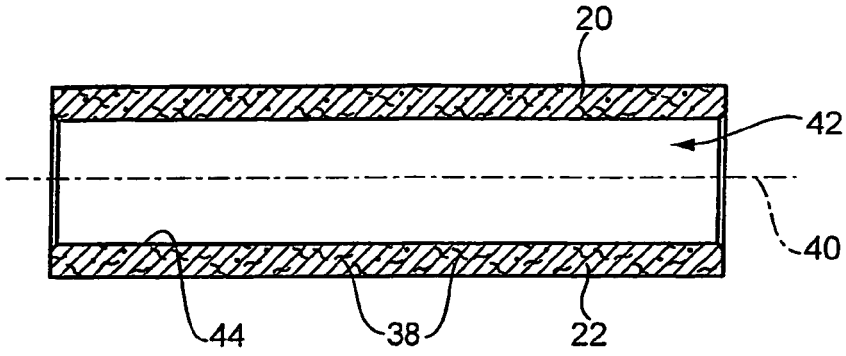

FIG. 5 shows a schematic representation of a reinforcing element 20 which can be integrated into a wheel and which takes the form of a strengthening tube 22. The reinforcing element 20 is intended for embedding in the nave component 16 of a wheel, its inside wall 44 at least partially forming the wall of a nave hole of the wheel (for example the nave hole 42 of the wheel 10). The strengthening tube 22 is provided with reinforcing fibers 38 inlaid in the basic material. The reinforcing fibers 38 are here not connected together but lie irregularly distributed in the basic material of the strengthening tube. The reinforcing element 20 can be prefabricated, for example, as a so-called "preform", to be then laid in a mold for manufacturing of the wheel. In the case of a wheel having a strengthening tube 22, the strengthening tube axis 22 corresponds to the axis of rotation 40 of the wheel. A wheel 10 of such a design may, where necessary, be additionally or alternatively provided with at least one reinforcing element 20.

The aforementioned design features are especially suited to the manufacture of a compressor wheel and in particular of a compressor wheel for an exhaust-gas turbocharger for a motor vehicle. Aluminum, for example, is suitable as basic material for the main body 12, whilst the reinforcing structure 14, may be composed of high-strength metal fibers or carbon fibers or glass fibers. The use of a reinforcing structure 14 at least partially integrated inside the main body 12, particularly in a compressor wheel for an exhaust-gas turbocharger, means that possible nave fractures can be prevented or at least decisively reduced even under extremely high wheel stresses. The facility for a widely varying design of the reinforcing structure 14 now makes it possible and relatively inexpensive to significantly increase the strength of the wheel 10, particularly in a radial direction. There is therefore no need to resort to relatively expensive materials such as titanium in order to obtain an adequately serviceable wheel. In production engineering terms the reinforcing structure 14 in the form of a mesh inlay 24, acting as high-strength supporting skeleton, can be readily anchored in the wheel in the casting processing, making it possible to purposely reinforce the load-bearing capacity of the wheel in those areas in which the highest operating stresses are usually to be expected. The operating stresses of the wheel 10 are absorbed by the reinforcing structure 14 owing to its relatively high strength in conjunction with the basic material (for example aluminum) of the wheel 10. Here, stresses, in particular tensile stresses acting on the wheel 10 can be beneficially compensated for. By arranging the mesh inlay 24 in an area of the wheel 10 close to the surface, the reinforcing structure 14 is able, like a net, to catch operating centrifugal stresses occurring in the wheel 10 like a net, forming tensile stresses. It is even possible, where necessary, to subject the reinforcing structure 14 in the main body 12 to pretensile stresses on a principle similar to "prestressed concrete", so that in the event of compressive stresses acting of the main body 12 these can be at least partially compensated for by the pretensile stresses. Owing to the prestressed reinforcing structure 14, therefore, a size-reducing tensile stress condition occurs in the main body 12 only in excess of a specific operating speed of the wheel 10.

The differences in material characteristics, particularly in the strength of the main body material and the reinforcing structure material, can give the wheel and in particular the blade component desirable damping characteristics. As a result, resonance stresses occurring in wheel operation can be sustained without damage.

The high-strength material characteristics of the reinforcing structure and in particular the relatively high modulus of elasticity of the reinforcing structure material allow the thermal expansion of the wheel during operation to be purposely reduced or limited, so that even allowing for the centrifugal forces occurring during operation of the wheel a relatively tight wheel-fitting gap dimension can be precisely adhered to. This is particularly important in compressor wheels for exhaust-gas turbochargers, which can reach operating temperatures of up to 250° C. A precisely maintainable gap dimension of a fitted wheel leads to a reduction of the ensuing friction losses and hence to an increase in the efficiency of the overall system.

The reinforcing structure 14 composed of a fiber system is therefore arranged in the main body 12 of the wheel 10 in such a way that a definite increase in strength, especially in a radial direction, is largely obtained in the critical wheel areas. This makes it possible to reduce any risk of fracture, especially in the nave component 16 due to the high centrifugal forces and/or the thermal expansion during operation of the wheel 10. At the same time the wheel 10 with integrally cast reinforcing structure 14 can be manufactured relatively easily and inexpensively.

The invention claimed is:

1. A wheel (10), comprising:

a main body (12), and at least one reinforcing structure (14) for increasing a strength of the wheel (10), wherein the reinforcing structure (14) is at least partially integrally cast in the main body (12), and wherein the reinforcing structure (14) is prestressed under a pretensile stress serving to increase a compressive strength.

2. The wheel as claimed in claim 1, wherein the main body (12) has a nave component (16) and a blade component (18), the reinforcing structure (14) being arranged in the nave component (16) and/or in the blade component (18).

3. The wheel as claimed in claim 1, wherein the reinforcing structure (14) takes the form of a prefabricated reinforcing element (20).

4. The wheel as claimed in claim 3, wherein the reinforcing element (20) takes the form of a strengthening tube (22), which is integrated in the nave component (16) of the wheel (10).

5. The wheel as claimed in claim 1, wherein the reinforcing structure (14) has a multiplicity of reinforcing fibers (38) freely distributed in the main body (12).

6. The wheel as claimed in claim 1, wherein the reinforcing structure (14) has high-strength metal fibers and/or carbon fibers and/or glass fibers.

7. The wheel as claimed in claim 1, wherein the main body (12) is manufactured using aluminum as basic material.

8. The wheel as claimed in claim 1, wherein the wheel is a compressor wheel and in particular a compressor wheel for an exhaust-gas turbocharger of a motor vehicle.

9. A wheel (10), comprising:

a main body (12), and at least one reinforcing structure (14) for increasing a strength of the wheel (10), wherein the reinforcing structure (14) is at least partially integrated inside the main body (12), wherein the reinforcing structure (14) is prestressed under a pretensile stress serving to increase a compressive strength, and wherein the reinforcing structure (14) has a mesh inlay (24).

10. The wheel as claimed in claim 9, wherein the mesh inlay (24) comprises a plurality of mesh components (26, 28, 30) extending in a radial direction and/or in an axial direction and/or in a peripheral direction in relation to the wheel (10).

11. The wheel as claimed in claim 9, wherein the mesh inlay (24) is arranged, at least in part, immediately below the surface (31) of the main body (12).

12. The wheel as claimed in claim 9, wherein the mesh inlay (24) is arranged at least partially at the surface (31) of the main body (12).

13. A wheel (10), comprising:

a main body (12), and at least one reinforcing structure (14) for increasing a strength of the wheel (10), wherein the reinforcing structure (14) is at least partially integrated inside the main body (12), wherein the reinforcing structure (14) is prestressed under a pretensile stress serving to increase a compressive strength, and wherein the reinforcing structure (14) additionally has a reinforcing component (32) arranged entirely externally in relation to the main body (12) and fixed thereto.

14. The wheel as claimed in claim 13, wherein the external reinforcing component (32), as a stiffening element (34) at least partially reproducing the blade geometry, is provided with an at least partially integrated inlay structure (36).

15. The wheel as claimed in claim 13, wherein the external reinforcing component (32) takes the form of a high-strength circular banding unit.

* * * * *